US007520303B2

(12) United States Patent
Mertens et al.

(10) Patent No.: US 7,520,303 B2
(45) Date of Patent: Apr. 21, 2009

(54) METHOD FOR WEAVING A FABRIC, FABRIC WOVEN BY MEANS OF SUCH A METHOD AND WEAVING MACHINE FOR WEAVING SUCH A FABRIC

(75) Inventors: Jos Mertens, Kortrijk (BE); Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 351 days.

(21) Appl. No.: 11/473,584

(22) Filed: Jun. 23, 2006

(65) Prior Publication Data

US 2007/0006932 A1 Jan. 11, 2007

(30) Foreign Application Priority Data

Jun. 24, 2005 (BE) ..... 2005/0324
Apr. 4, 2006 (EP) ..... 06112213

(51) Int. Cl.

*D03D 39/10* (2006.01)
*D03D 39/16* (2006.01)
*D03D 39/02* (2006.01)
*D03D 39/00* (2006.01)
*D03D 39/20* (2006.01)

(52) U.S. Cl. ..... 139/21; 139/47; 139/102; 139/116.5; 139/443; 139/446

(58) Field of Classification Search ..... 139/21, 139/37–47, 102, 116.5, 438, 439, 443, 446
See application file for complete search history.

(56) References Cited

U.S. PATENT DOCUMENTS 128,286 A * 6/1872 Crompton ..... 139/403
939,230 A * 11/1909 Dornan ..... 139/411
1,349,367 A * 8/1920 Crossland ..... 139/405
1,932,981 A * 10/1933 Milnes ..... 139/413
2,599,293 A * 6/1952 Symonds ..... 139/37
2,647,546 A * 8/1953 Ryan ..... 139/403
2,860,669 A * 11/1958 Moberg ..... 139/402
3,289,706 A * 12/1966 Valentine ..... 139/21
3,625,260 A * 12/1971 Troy ..... 139/402
3,943,981 A 3/1976 De Brabander
5,465,761 A * 11/1995 Gheysen ..... 139/21
5,615,712 A * 4/1997 Derudder et al. ..... 139/21
5,655,573 A * 8/1997 Gheysen et al. ..... 139/21
6,092,562 A * 7/2000 Debaes ..... 139/398

(Continued)

FOREIGN PATENT DOCUMENTS

EP 0628649 12/1994

(Continued)

*Primary Examiner*—Bobby H Muromoto, Jr.
(74) *Attorney, Agent, or Firm*—James Creighton Wray

(57) ABSTRACT

A method for weaving a fabric having:

a backing fabric (100, 200) formed by backing warp yarns, having binding warp yarns (101, 201) and first and second weft yarns (3, 4);

one or several tension warp yarns (102, 202, 103, 203); and non-pattern forming and/or pattern forming pile warp yarns (7, 6), the pattern forming pile warp yarns (6) form pattern forming pile burls (6*a*), and each pattern forming pile burl (6*a*) is interlaced round at least one third weft yarn (5) situated at the back of the fabric (1, 2) with respect tote tension warp yarns (102, 202, 103, 203).

43 Claims, 10 Drawing Sheets

U.S. PATENT DOCUMENTS

| | | | | |
|---|---|---|---|---|
| 6,102,083 | A * | 8/2000 | Vandoorne | 139/391 |
| 6,173,746 | B1 * | 1/2001 | Debaes et al. | 139/392 |
| 6,186,189 | B1 * | 2/2001 | Gheysen | 139/392 |
| 6,247,506 | B1 * | 6/2001 | Debaes et al. | 139/402 |
| 6,273,148 | B1 * | 8/2001 | Debaes et al. | 139/402 |
| 6,289,941 | B1 * | 9/2001 | Debaes | 139/402 |
| 6,336,475 | B2 * | 1/2002 | Dewispelaere et al. | 139/391 |
| 6,343,626 | B1 * | 2/2002 | Demey et al. | 139/398 |
| 6,457,489 | B2 * | 10/2002 | Smissaert | 139/21 |
| 6,457,490 | B2 * | 10/2002 | Dewispelaere et al. | 139/391 |
| 6,502,605 | B2 * | 1/2003 | Goessl et al. | 139/21 |
| 6,817,383 | B2 * | 11/2004 | Debaes et al. | 139/21 |
| 6,837,274 | B2 * | 1/2005 | Debaes et al. | 139/21 |
| 6,945,280 | B2 * | 9/2005 | Debaes | 139/21 |
| 7,086,424 | B2 * | 8/2006 | Debaes et al. | 139/418 |
| 7,111,647 | B2 * | 9/2006 | Debaes | 139/21 |
| 7,240,698 | B2 * | 7/2007 | Debaes | 139/37 |
| 7,395,839 | B2 * | 7/2008 | Debaes | 139/21 |
| 2001/0010236 | A1 * | 8/2001 | Dewispelaere et al. | 139/391 |
| 2001/0050112 | A1 * | 12/2001 | Smissert | 139/383 A |
| 2002/0036021 | A1 * | 3/2002 | Goessl et al. | 139/2 |
| 2003/0226613 | A1 * | 12/2003 | Debaes et al. | 139/408 |
| 2004/0084101 | A1 * | 5/2004 | Debaes | 139/2 |
| 2004/0221915 | A1 * | 11/2004 | Debaes et al. | 139/409 |

FOREIGN PATENT DOCUMENTS

| | | |
|---|---|---|
| GB | 28221 | 0/1914 |

* cited by examiner

METHOD FOR WEAVING A FABRIC, FABRIC WOVEN BY MEANS OF SUCH A METHOD AND WEAVING MACHINE FOR WEAVING SUCH A FABRIC

This application claims the benefit of Belgian Application No. 2005/0324 filed Jun. 24, 2005 and European Application No. 06112213.1 filed Apr. 4, 2006, which are hereby incorporated by reference in their entirety.

BACKGROUND OF THE INVENTION

On the one hand, the invention relates to a method for weaving a fabric comprising:

a backing fabric formed by backing warp yarns, comprising binding warp yarns, and first and second weft yarns;

one or several tension warp yarns;

non-pattern forming and/or pattern forming pile warp yarns, pattern forming pile burls being formed by the pattern forming pile warp yarns, and each pattern forming pile burl being interlaced round at least one third weft yarn situated at the back of the fabric with respect to the tension warp yarns.

On the other hand, the invention relates to a fabric comprising:

a backing fabric, formed by backing warp yarns, comprising binding warp yarns and first and second weft yarns;

one or several tension warp yarns;

non-pattern forming and/or pattern forming pile warp yarns, the pattern forming pile warp yarns being provided to form pattern forming pile burls, and each pattern forming pile burl being interlaced round at least one third weft yarn which is situated at the back of the fabric with respect to the tension warp yarns.

Hand-knotted fabrics, for instance, carpets are characterized by:

a high density;

a fine design;

a perfect back, showing no warp yarns.

To produce a hand-knotted fabric a multitude of warp yarns are vertically arranged next to one another between a warp beam to supply the warp yarns and a cloth beam for winding the knotted cloth. Between the two, warp yarns are tightened.

When hand-knotting, the knotter is knotting horizontally pile yarns round the warp yarns, usually the knot being interlaced round two adjacent warp yarns (as represented in "Die Teppichindustrie", Hans Oswald, 1965, Meliand Textilberichte, Heidelberg, pages 174 and 175). When horizontally a complete row of knots is made, one or several wefts are inserted between the warp yarns and, by means of a reed, the weft(s) is (are) beaten up against the knots, which in turn are beaten up against the fabric already formed. Then the knotter may make another row of knots and repeat the process.

From the figures can be deduced that the warp yarns are completely surrounded by the knotted pile yarn, which means that they will cover the warp yarns at the back. When the row of knots is well beaten up, which is required in order to obtain a high quality knotted fabric having a good pile anchorage, no backing warp yarns may appear at the back of the fabric, because of which the pattern of the fabric is perfect, also at the back. It is possible to produce hand-knotted fabrics, such as carpets, having high densities and a very clear pattern. Hand-knotting, however, is a very labour intensive production method.

Weaving itself, and more particular face-to-face weaving is a far more productive production method. However, with these weaving techniques, the pile warp yarn is interlaced round weft yarns, which at best are extending at the back of the fabric with respect to a tension warp yarn and a large part of the backing warp yarns are running visibly at the back of the fabric, because they interlace the weft yarns in the backing fabric, also those at the back of the fabric. The back of such fabrics therefore has a completely different aspect than the back of a knotted carpet.

SUMMARY OF THE INVENTION

On the one hand, the purpose of the invention is to provide a method for weaving a fabric according to the heading of the first claim, where the back of the fabric is coming close to the quality of a hand-knotted fabric.

This purpose of the invention is obtained by providing a method for weaving a fabric, comprising:

a backing fabric formed by backing warp yarns, comprising binding warp yarns and first and second weft yarns;

one or several tension warp yarns;

non-pattern forming and/or pattern forming pile warp yarns, pattern forming pile burls being formed by means of the pattern forming pile warp yarns, and each pattern forming pile burl being interlaced round at least one third weft yarn situated at the back of the fabric with respect to the tension warp yarns, and each said third weft yarn being situated outside the backing fabric.

By applying this method, hardly any warp yarn will be visible at the back of the fabric.

In a first preferred method according to the invention, binding warp yarns may interlace said second weft yarns which are situated at the back of the fabric with respect to the tension warp yarns and round which no pile warp yarns are interlaced. Because of this, neither these binding warp yarns will be visible, as the pile warp yarns are significantly thicker than the binding warp yarns and most certainly with a fabric of a high weft density, the binding warp yarn, interlacing the said second weft yarn, will be pushed away between two successive third weft yarns which will be interlaced only by a pile warp yarn and not by a binding warp yarn.

In a second preferred method according to the invention, binding warp yarns may interlace the said second weft yarns which are situated on the pile face of the fabric with respect to the tension warp yarns, which are situated closest to the back of the fabric.

Besides, on the one hand, at least part of the second weft yarns can be provided between the said tension warp yarns which, are situated closest to the back of the fabric, and the non-pattern forming pile warp yarns. In this manner, the second weft yarn which is interlaced by a binding warp yarn, is made still more invisible from the back of the fabric.

In an advantageous method according to the invention, the binding warp yarns are interlacing the said first weft yarns which are situated on the pile face of the fabric with respect to the tension warp yarns.

A preferred method according to the invention consists in that the non-pattern forming pile warp yarns are made to be floating between the first and the second weft yarns which are interlaced in the backing fabric by the binding warp yarns. Thus, also the non-pattern forming pile warp yarns will help to keep the first and second weft yarns separated from one another and to allow weaving at higher densities.

A further preferred method according to the invention consists in that the non-pattern forming pile warp yarns are made floating between the first weft yarns of the lower fabric and the first weft yarns of the upper fabric. After cutting through the fabrics, both fabrics may be subjected to a scraping operation, so that the non-pattern forming pile warp yarns are removed from the fabric.

The first weft yarns on the pile face of the fabric may be inserted either simultaneously or during different weft insertion cycles together with the third weft yarns round which pattern forming pile warp yarns are interlaced.

By simultaneous insertion, a weavestructure is obtained in which between the pile legs two weft yarns are situated above one another, so that the pile is maintained nicely in an upright position and whereby it is possible to realize high densities, the pile tufts being rather slightly pushed open.

The second weft yarns which are inserted at the back of the fabric with respect to the non-pattern forming pile warp yarns and which are interlaced by the binding warp yarns may be inserted either simultaneously with the first weft yarns or during a different weft insertion cycle. These weave structures have the advantage that the pile burls may be spread open less which will result in a more clearly defined pattern on the pile face of the fabric.

In a first advantageous method according to the invention, for face-to-face fabrics, the first, second and third weft yarns may be inserted by means of triple weft insertion means. With a triple weft insertion means, productivity is fifty percent higher than with a double rapier weft insertion.

Preferably, with face-to-face fabrics, besides cut piles, there will also be loop piles and/or piles which are interlaced round first weft yarns, the third weft yarns round which the pattern forming pile warp yarns are interlaced being outside the backing fabric.

In a second advantageous method according to the invention, for face-to-face fabrics, the first, second and third weft yarns may be inserted by means of a double weft insertion. In this manner, ⅓ V-structures are realized, which have the advantage that no mixed contours will appear at a pile change and a clearly defined fabric will be obtained at a colour change without any weave corrections being required.

In a preferred method according to the invention, for single fabrics, the first, second and third weft yarns may be inserted by means of double weft insertion means, two weft yarns being inserted during a first weft insertion cycle and only one weft yarn is inserted during a second successive weft insertion cycle. This method presents similar advantages as the method for manufacturing face-to-face fabrics according to the invention, where triple weft insertion means is used.

In an advantageous method according to the invention, for single fabrics, the first, second and third weft yarns are inserted by means of single weft insertion means. This method can be used when a single fabric weaving machine is available with a single weft insertion, and has likewise the advantage that no mixed contours will appear, so that the pattern on the pile face will be finer and no corrections will be needed to control the production of these fabrics in order to avoid these mixed contours.

For face-to-face fabrics with triple weft insertion means and single fabrics with double weft insertion means, preferably the binding warp yarns will have a weave repeat of 4 or a multiple of 4.

For face-to-face fabrics with double weft insertion means and single fabrics with single weft insertion means, the binding warp yarns preferably have a weave repeat of 6 or a multiple of 6.

In case of a weave repeat of the binding warp yarns being a multiple of 4 or a multiple of 6, less warp yarn is used because of fewer crossings of binding warp yarns, enabling higher densities to be realized.

Furthermore, the binding warp yarns may have a weave repeat of at least 8, which is a multiple of repeat 4 or a multiple of repeat 6, and between the crossing of the binding warp yarns, at least during one weft insertion cycle no weft yarn being guided through the fabric by a weft insertion means, which weft yarn, if it would indeed have been inserted, would have been interlaced by the binding warp yarns in the backing fabric.

In a preferred method according to the invention, at least part of the tension warp yarns, linked to a weaving frame drive performing a motion during which, after insertion of a third weft yarn which is situated at the back of the fabric with respect to the tension warp yarns and which is not interlaced by the binding warp yarns and round which pattern forming pile warp yarns are interlaced, the weaving frame is moving towards the back of the fabric in order to pull the third weft yarn, round which the pattern forming pile warp yarns are interlaced, towards the outside of the jaw opening. This has the advantage that a better guarantee can be given for the pile height of the pattern forming pile and a better quality of the fabric may be realized and a more perfect back of the fabric will be obtained.

In a further advantageous embodiment of a method according to the invention with weave structures having a weave repeat of a multiple of 4 or 6, at least part of the second weft yarns which are interlaced by the binding warp yarns are situated on the pile side of the tension warp yarns which are closest to the back of the fabric.

This has the advantage that part of the second weft yarns are no longer situated at the back of the fabric and, as a third layer will be able to force its way upwards between the layers of other weft yarns and dead pile warp yarns (non-pattern forming pile warp yarns). Because of which more pile burls per unit of length may be inserted into the fabric and higher densities may be realized. This is true both for face-to-face fabrics and single fabrics.

In an advantageous method according to the invention, the second tension warp yarns are separating the third weft yarns from the backing fabric constituted by the binding warp yarns and the first tension warp yarns, the binding warp yarns interlacing the first and second weft yarns and the second weft yarns being situated between the first and second tension warp yarns and the first weft yarns being situated on the pile face of the fabric with respect to the tension warp yarns. By using second tension warp yarns being situated outside the backing fabric on the back of the fabric a still better separation between the third and the second weft yarns is realized. This will render the back still more perfect and the wefts will still be better arranged in layers which will result in a higher density of the fabric.

Preferably, in doing so, the weft insertion occurs simultaneously by means of one or two weft insertion means, a third weft yarn, a first weft yarn and a second weft yarn being inserted into each fabric successively, after which the cycle is repeated. The sequence described here indicates a sequence of weft insertion per fabric, in which weft yarns may also be inserted simultaneously.

In order to firmly integrate the backing fabric, which has been made completely invisible from the back of the fabric by the method applied, into the fabric, pile forming with face-to-face fabrics preferably occurring with W-pile, by interlacing the pile warp yarn, when a pattern forming pile warp yarn is moving from one fabric to the other, round a third weft yarn situated at the back of the fabric with respect to the tension warp yarns and which is situated outside the backing fabric and then to pass round a first weft yarn in the same fabric and then round a second weft yarn, which is interlaced by a binding warp yarn and is separated from the third weft yarns by a tension warp yarn and to extend towards the other fabric. In this manner, it will be possible to realize an extremely well perfect back where no binding warp yarns may be observed. Combined with this single-rapier method, this weave structure will present a very good pile anchorage coming close to the pile anchorage of a hand-knotted fabric.

The lower pile density may be compensated by applying this weave structure in opposition with a double rapier weaving machine, each motion of the pile in one fabric being accompanied by a similar pile motion in the other fabric.

In the method according to the invention, the rapier inserting the third weft yarns which are not interlaced by the warp yarns of the backing fabric into a fabric which, during weaving, has its back directed downwards, during their motion through the shed, is not carried by yarns. The binding warp yarns which in the weaving processes, according to the state-of-the-art, are supporting these rapiers during their motion through the shed, are situated above these rapiers. On the contrary, the pile warp yarns which will be interlaced, are indeed below this lower rapier, but at a level that is to low to guide the rapier, because, at other insertion cycles, the binding warp yarns are indeed situated under the lower rapiers and a separation as to level between binding warp yarns and pile warp yarns is highly desirable, because a systematic crossing between these two groups of warp yarns is disadvantageous for the weaving process. Without such a guide, the lower rapiers are unable to guide the third weft yarn with operational safety through the shed or to pass it on in the central position.

In order to solve this problem, for fabrics with the back below, the pile warp yarns which, in order to form the lower fabric, are interlaced round the third weft yarns, are lifted into a position which, from the position of the weaver, is situated behind the rapiers, this position being chosen such, that these pile warp yarns, at the level of the lower rapier, are positioned almost exactly under this lower rapier, and may be able to perform a guiding function for this rapier in his motion through the shed.

Such a positioning may occur by:

using a weaving frame with a multitude of heddles which are provided with heddle eyes, a cord, or wire or bar extending through several or all the heddle eyes of this weaving frame in the weft direction and this weaving fame, before inserting the third weft yarns, being lifted, so that the cord, wire or bar will bring the pattern forming pile warp yarns situated under this rapier, almost exactly under the lower rapier;

dimensioning the weaving frames for driving the binding warp yarns in the upper fabric, so that they, in their highest position, i.e. binding warp yarns above the upper rapier, will also lift, by means of a cord, wire, bar or beam extending in the weft direction, the pattern forming pile warp yarns, which are situated in the lower position, in order to position them almost exactly under the lower rapier;

using one or several servo-driven weaving frames, the motion of the weaving frame being adjustable and programmable as to height, and these weaving frames with binding warp yarns which, the moment the lower rapier has to be supported, are situated above the upper rapier, are driven, slightly higher than usual, when they have been provided with a device to lift the pattern forming yarns under the lower rapier in order to position them almost exactly under the lower rapier;

using a weaving frame or table moving up and down, the top face of which is provided with a plane which will position the pattern forming pile warp yarns almost exactly under the lower rapier;

using a fixed table which will always position the pattern forming pile warp yarns almost exactly under the lower rapier, preferably the table being installed as close as possible to the rapiers, in order to keep the areas in which the pile warp yarns and binding warp yarns are coinciding as short as possible in the positions where also binding warp yarns are situated under the lower rapier.

This problem may also be solved by providing additional warp yarns which are no part of the fabric and will take up a fixed position or a position controlled by a shed forming means, in order to support the lower rapier, when inserting a third weft yarn into the fabric with the back of the fabric below.

In a first advantageous method according to the invention, single fabrics are woven by means of a wire weaving machine, the cutting wires being used to form a cut pile and/or loop wires being used to form loop piles.

In a more advantageous method according to the invention, the wire weaving machine is equipped with a band rapier as a weft insertion means, this band rapier being guided during the trajectory through the shed. This has the advantage that no additional warp yarns have to be provided or no additional facilities have to be made to position the pile warp yarns at the level of the lower rapier exactly under the rapier.

In a second advantageous method according of the invention, the single fabrics are woven by means of an Axminster weaving machine, where between crossing the binding warp yarns a second and a third weft yarn are laid at the back of the fabric with respect to the tension warp yarns and a first weft yarn on the pile face of the fabric with respect to the tension warp yarn, and the third weft yarn round which the rapiers are laying pile, is interlaced by this pile outside the backing fabric.

In a more advantageous method according to the invention, two wefts are inserted per weft insertion, so that, together with the second weft yarns, in addition, fourth weft yarns are inserted, which as the first weft yarns are situated on the pile face of the fabric with respect to the tension warp yarns, and are interlaced by binding warp yarns. This weave structure has the advantage of having the same density of weft yarns and warp yarns, both pile and backing warp yarns on either side of the tension warp yarns. This will lead to a fabric that will curl up less and therefore will remain a more flat fabric.

In a more advantageous embodiment of a method according to the invention, the Axminster weaving machine is provided with a beating up reed, comprising a multitude of plate-shaped reed fingers, provided with recesses in order to support the lower rapier during its motion through the shed.

In order to increase the effect of the binding warp yarns not being visible at the back of the fabric, a third weft yarn may be chosen with a higher thickness than the thickness of the second weft yarns. In this manner the binding warp yarn being interlaced round a thinner weft yarn will be hidden better still between two successive pattern forming pile warp yarns, each of which will be interlaced round a thick weft yarn. This has the additional advantage that the back of the fabric will be come more perfect and the dead pile will become less visible through the back of the fabric, so that the lower and the upper fabric will have a similar back. This difference of thicknesses between the second and third weft yarns has the advantages both when the second weft yarn is situated at the back of the fabric and on the pile face of the fabric with respect to the tension warp yarns which are situated closest to the back of the fabric.

The third and first weft yarns may be either almost of the same thickness, but the first weft yarns may also have a thickness which is smaller than the thickness of the third weft yarns. The varying thicknesses of these weft yarns with respect to one another enable various effects to be obtained as far as the position and the aspect of the pile yarns on the pile face of the fabric and the flatness of the carpet are concerned.

On the other hand, the purpose of the invention is to provide a fabric in accordance with the heading of claim 42, the quality of the back of the fabric coming close to quality of a hand-knotted fabric.

This purpose of the invention is attained by providing a fabric comprising:

a backing fabric made of backing warp yarns, consisting of binding and tension warp yarns, first and second weft yarns;

non-pattern forming and/or pattern forming pile warp yarns, the pattern forming pile warp yarns being provided to constitute the pattern forming pile burls, and each pattern forming pile burl being interlaced round at least one third weft yarn which is situated at the back of the fabric with respect to the tension warp yarns, each said third weft yarn being situated outside the backing fabric.

Preferably, this fabric is woven by means of a method as described above.

Finally, the purpose of the invention is to provide a weaving machine, weaving fabrics, of which the quality of the back of the fabric is coming close to the quality of a hand-knotted fabric.

This purpose of the invention is attained by providing a weaving machine which is provided to carry out a method as described above for weaving a fabric as described above.

Now this invention will be further explained on the basis of following detailed description of a preferred method according to the invention. The intention of this description is purely to provide an explanatory example and to point out the further advantages and particulars of this invention, and may therefore never be interpreted as a restriction of the field of application of the invention or of the patent rights demanded for in the claims.

In this detailed description, by means of reference numbers, reference is made to the attached drawings of which:

DETAILED DESCRIPTION OF THE PREFERRED EMBODIMENTS

Figure 1:
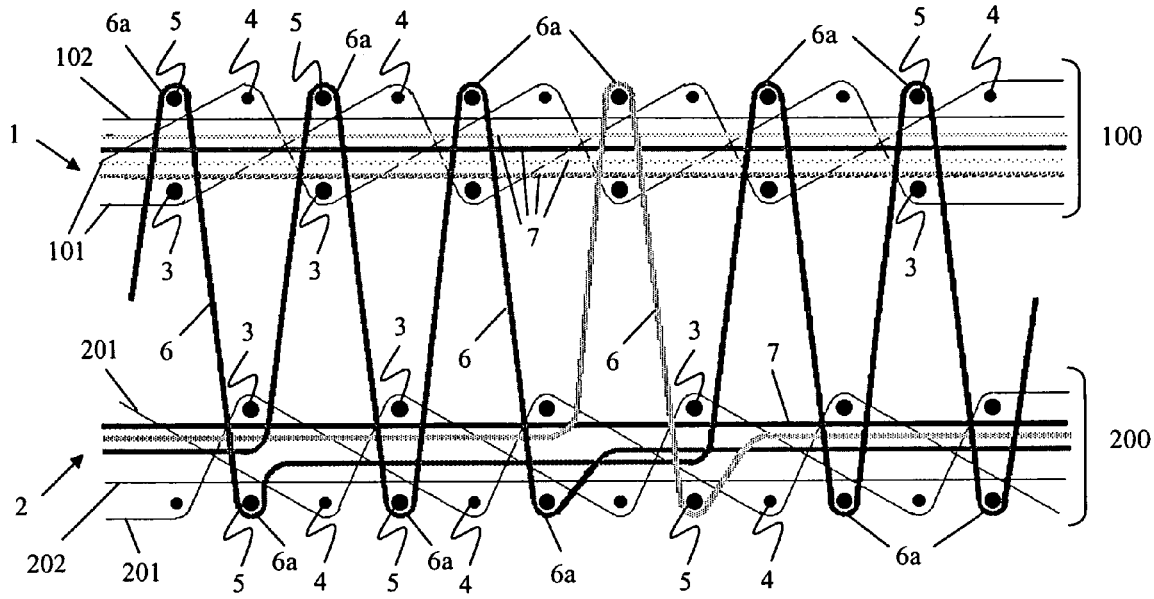
FIGS. 1 to 9 are representing schematic cross-sections of a face-to-face fabric in accordance with a preferred method according to the invention.
Figure 2:
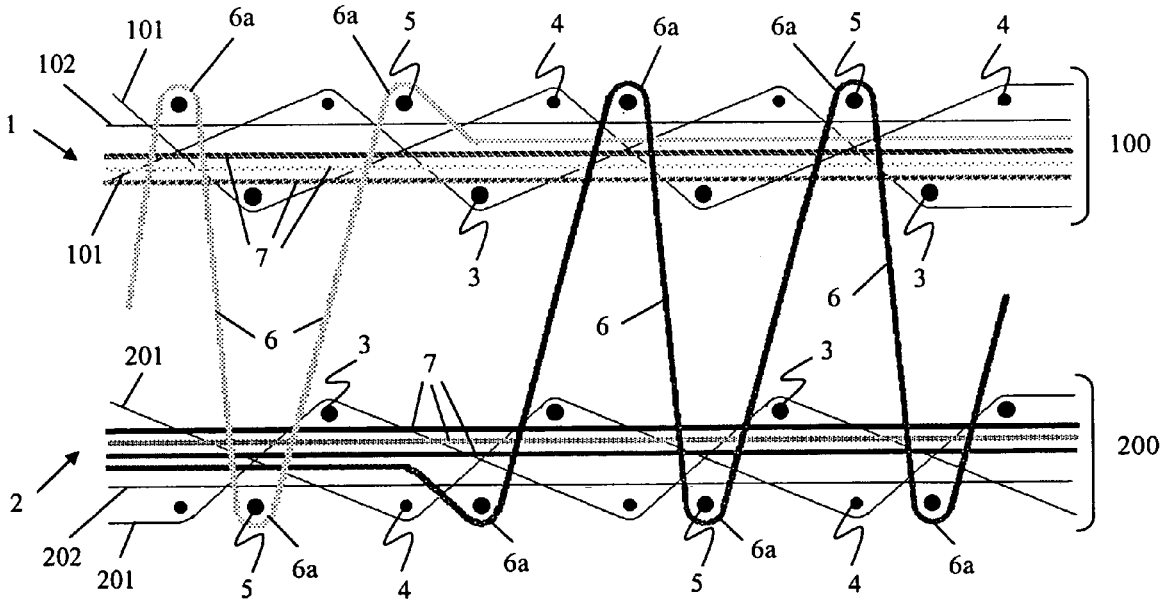
Figure 3:
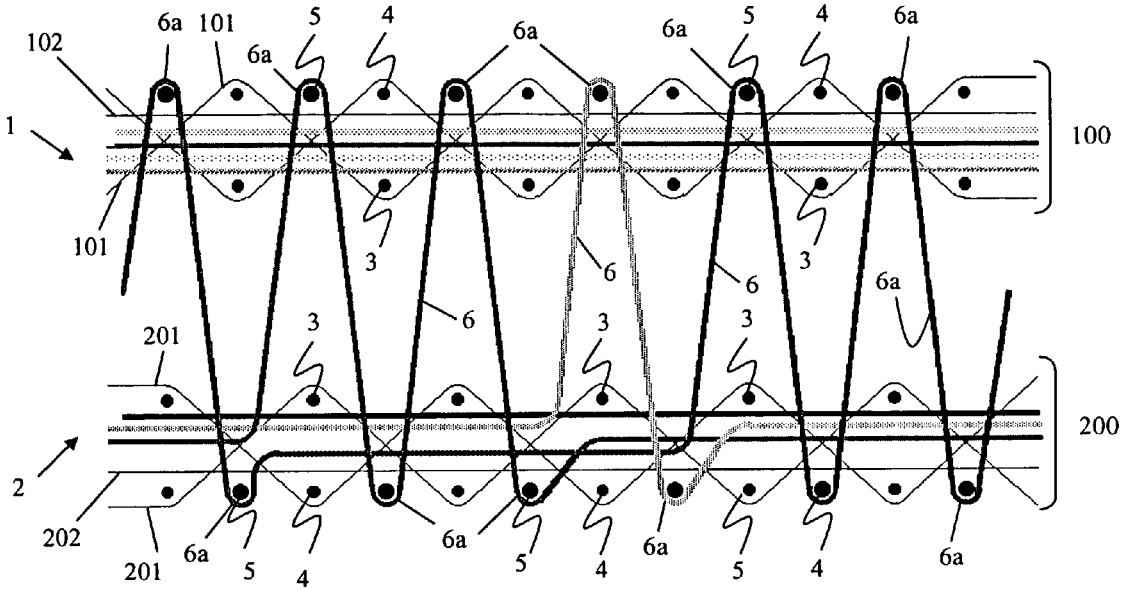
Figure 4:
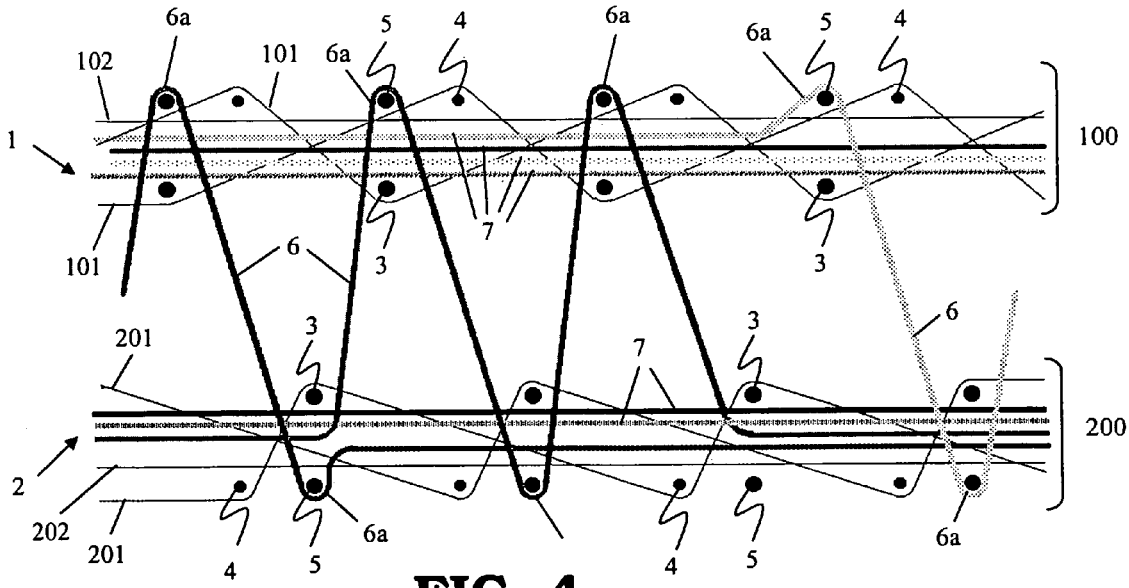
Figure 5:
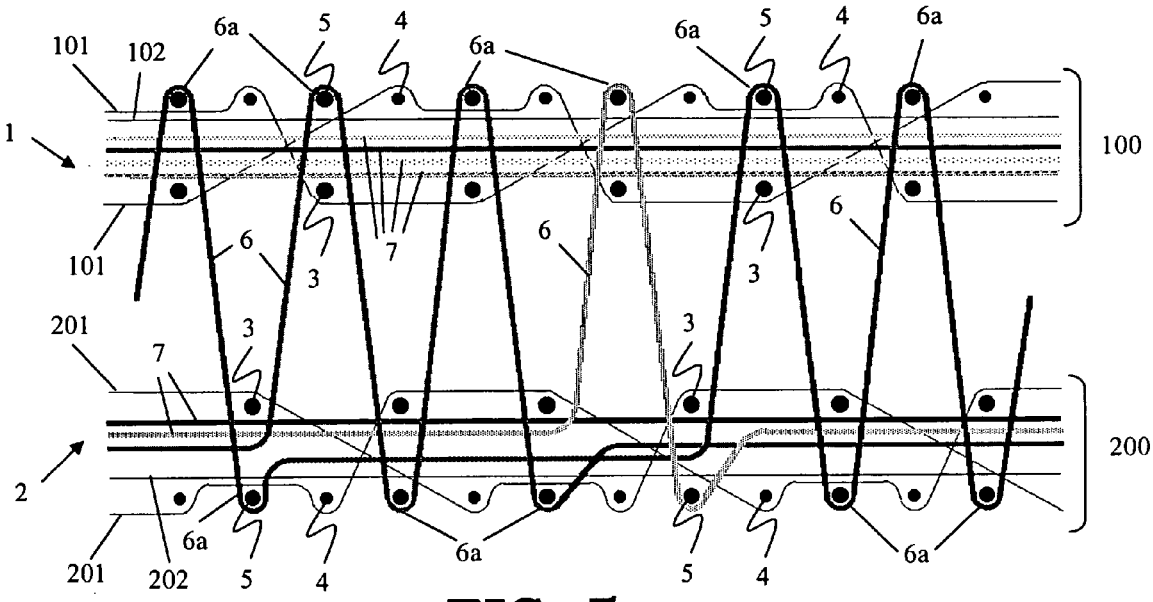
Figure 6:
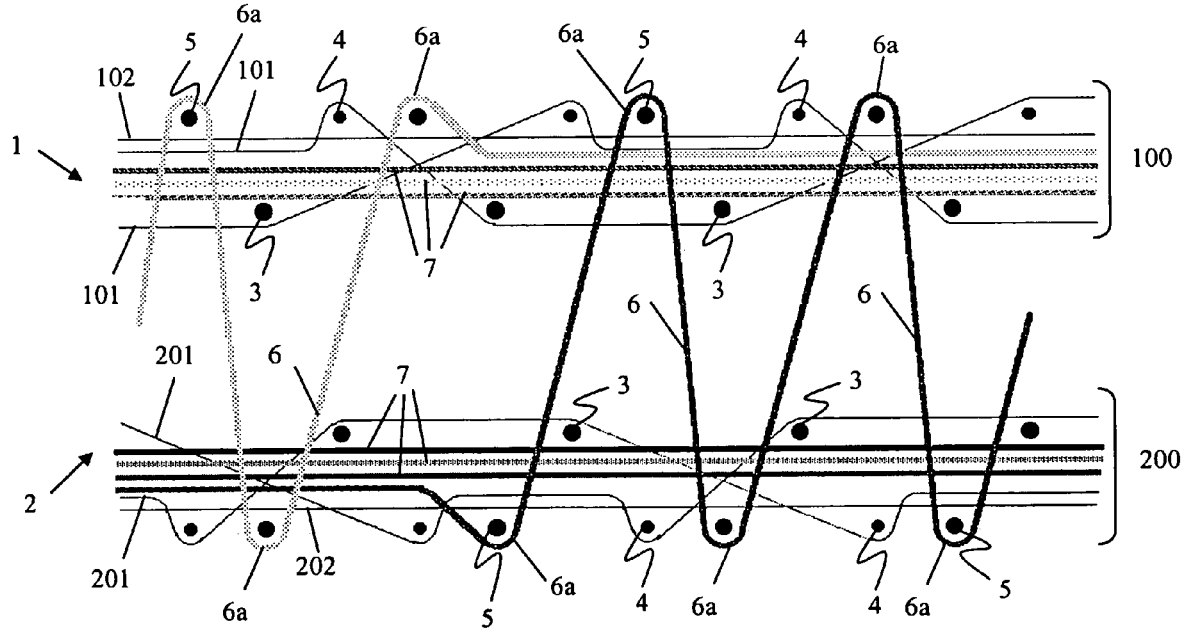

In a method for weaving a fabric (1, 2) according to the invention, the fabric (1, 2), the back of the fabric essentially showing the aspect of a hand-knotted carpet, a backing fabric (100, 200) is constituted from backing warp yarns, consisting of binding and/or tension warp yarns (101, 201, 102, 202) and first and second weft yarns (3, 4). In the FIGS. 1, 2, 3, 4, 5, 6, 7, 10, 11, 15, 17 and 18 tension warp yarns (102, 202) are situated in the backing fabric (100, 200). However, it is possible for the tension warp yarns (103, 203) to be situated outside the backing fabric (100, 200), as is the case in the FIGS. 8 and 9. Furthermore, both in the backing fabric (100, 200) and outside the backing fabric (100, 200), tension warp yarns (102, 202, 103, 203) may be provided, as is the case in the FIGS. 12, 13 and 14. Furthermore, the fabric (1, 2) is comprising non-pattern forming and/or pattern forming pile warp yarns (6, 7), pattern forming pile burls (6*a*) being formed by means of the pattern forming pile warp yarns (6), each pattern forming pile burl (6*a*) being interlaced round at least a third weft yarn (5), which is situated at the back of the fabric (1, 2) with respect to the tension warp yarns (102, 202, 103, 203) and each said third weft yarn (5) being situated outside the backing fabric (100, 200) (so these third weft yarns (5) are not interlaced by binding warp yarns (101, 201)), because of which warp yarns are no longer visible at the back of the fabric (1,2).

The said first weft yarns (3) are inserted on the pile face of the fabric (1, 2) with respect to the tension warp yarns (102, 202, 103, 203) and are interlaced by binding warp yarns (101, 102) in the backing fabric (100, 200).

Figure 7:
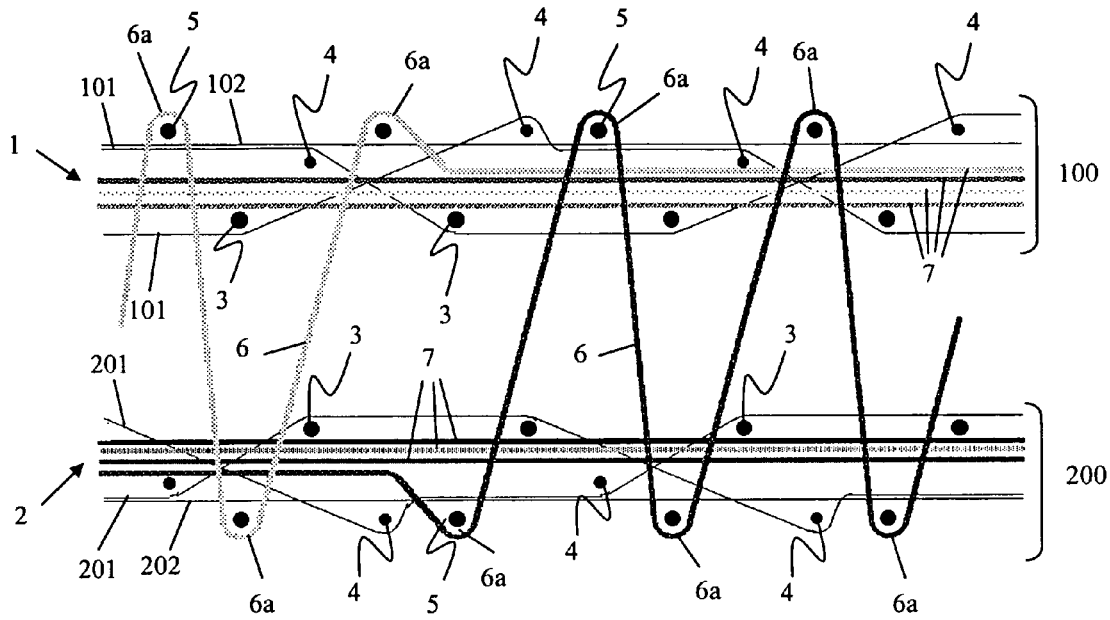
Figure 8:
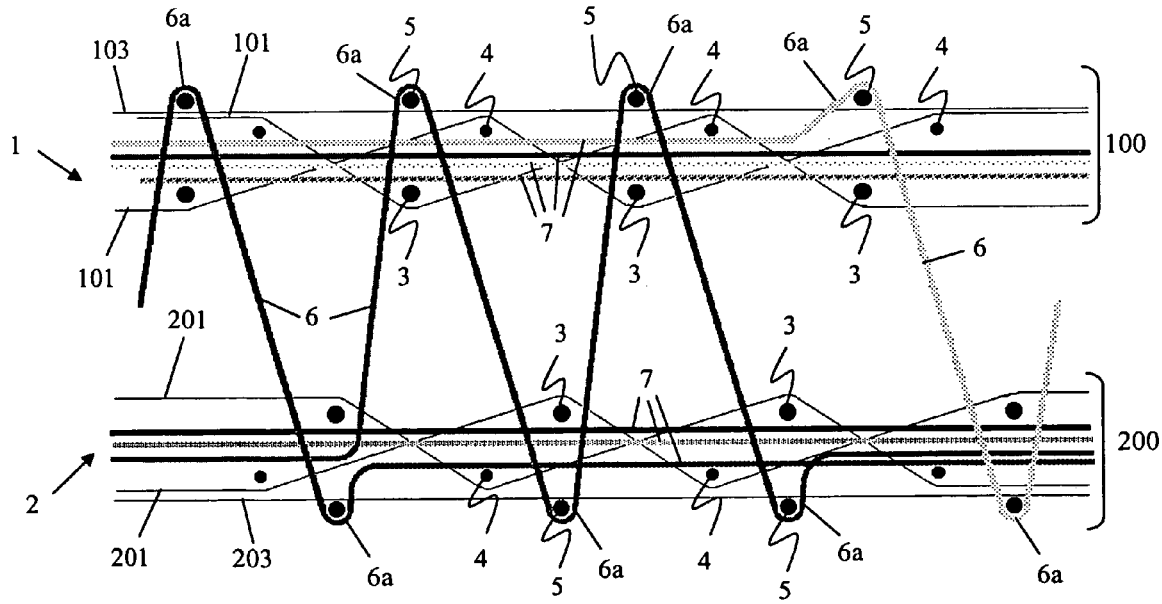

When, as represented in the FIGS. 1 up to and including 7, 10 and 15 up to and including 18, binding warp yarns (102, 201) are interlacing the said second weft yarns (4), which are situated at the back of the fabric (1, 2) with respect to the tension warp yarns (102, 202, 103, 203) and round which no pattern forming pile warp yarns (6) are interlaced, than they will not be visible either, as the pile warp yarns (6) are significantly thicker than the binding warp yarns (101, 201) and certainly with a fabric having a high weft density, the pile warp yarns pushing away the binding warp yarns (101, 102) interlacing the said second weft yarns between two successive third weft yarns (5) which are interlaced only by pile warp yarns (6) and therefore not by binding warp yarns (101, 201). The said second weft yarns (4) which are interlaced by binding warp yarns (101, 201) may be entirely or partially provided on the pile face with respect to the tension warp yarns (102, 202, 103, 203) situated closest at the back of the fabric (1, 2), but then at least part of these second weft yarns (4) are situated either between the first tension warp yarns (102, 202) which are provided in the backing fabric (100, 200) and second tension warp yarns (103, 203) which are provided outside the backing fabric (100, 200) (see FIGS. 12 up to and including 14 and 16), or between the said tension warp yarns (102, 202) at the back of the fabric (1, 2) and the non-pattern forming pile warp yarns (7) (=dead pile warp yarns) (see FIGS. 7 up to and including 9). In FIG. 7, part of the second weft yarns (4) are inserted between the tension warp yarns (102, 202) at the back of the fabric (1, 2) and the non-pattern forming pile warp yarns (7), whereas in FIG. 8 all second weft yarns (4) are inserted like this. Because of this, the binding warp yarns (101, 201) interlacing the second weft yarns (4) are hidden better still towards the back of the fabric (1, 2) than is the case in FIG. 7.

A preferred method is consisting in that the non-pattern forming pile (7) between the first and second weft yarns (3, 4) which are not interlaced in the backing fabric (100, 200) by binding warp yarns (101, 201) will be made to float.

In order to enhance the effect of the binding warp yarns (101, 201) not being visible at the back of the fabric, it is possible to provide third weft yarns (5) round which the pattern forming pile warp yarns are interlaced which are thicker than the first and second weft yarns (3, 4) which are interlaced in the backing fabric (100, 200). In this manner the binding warp yarns (101, 201) which are interlaced round the thinner weft yarns (3, 4) are hidden better still between two successive pattern forming pile warp yarns (6) each being interlaced round a thicker weft yarn (5). This has the additional advantage that the back is becoming more perfect and the dead pile will become less visible through the back of the fabric (1, 2), so that, with face-to-face fabrics, the upper and lower fabric (1, 2) will show a same back.

Figure 13:
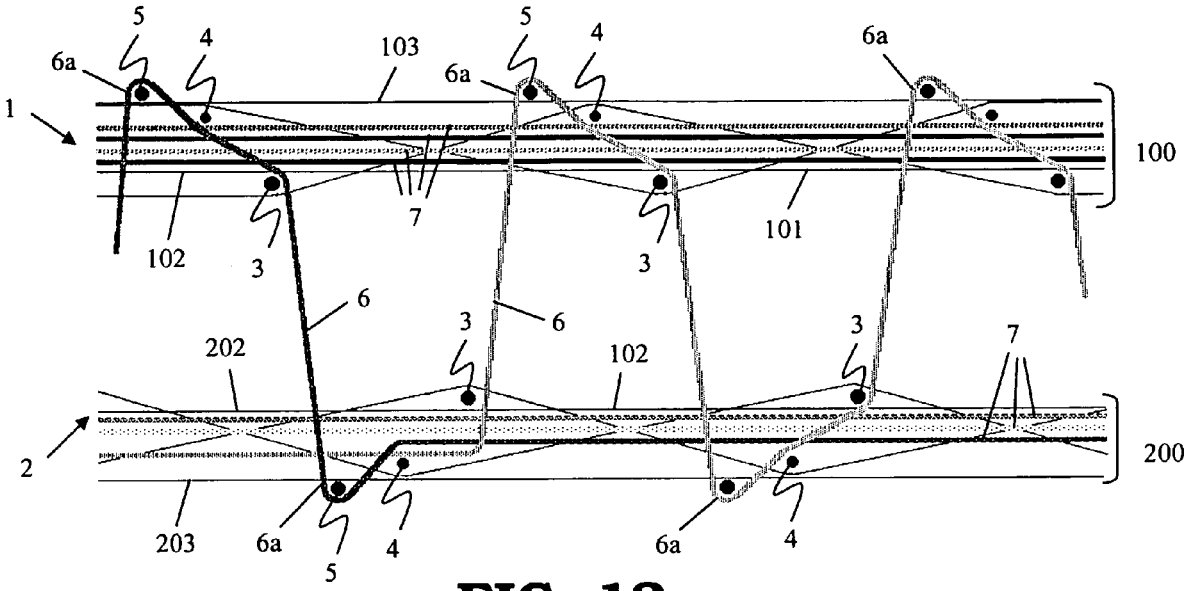
Figure 14:
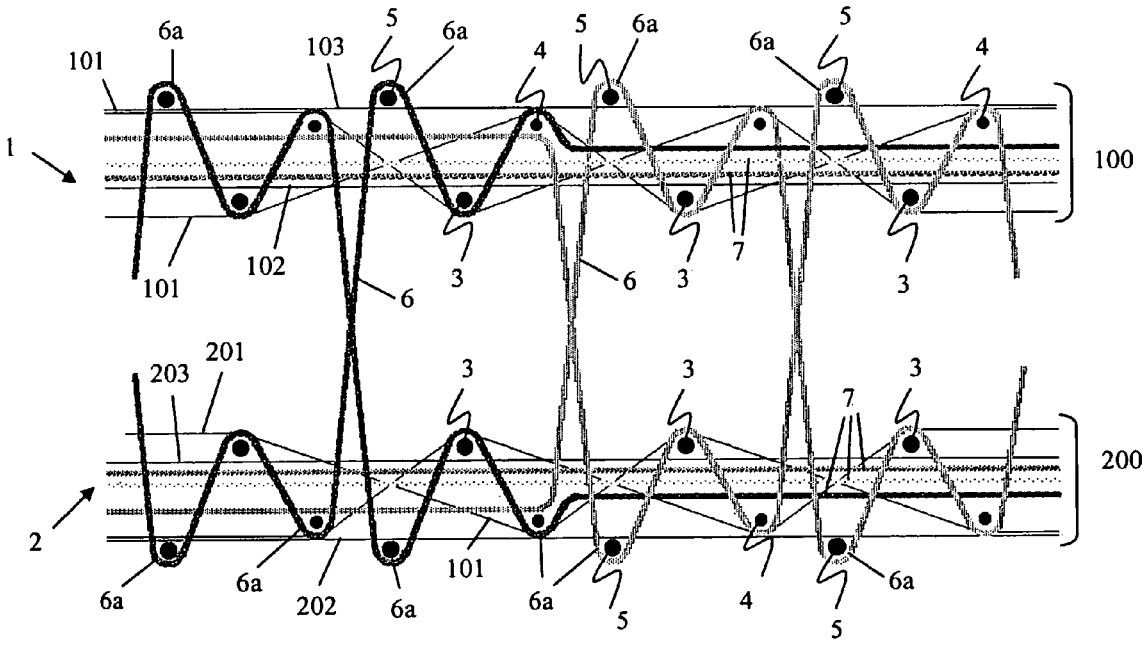
Figure 15:
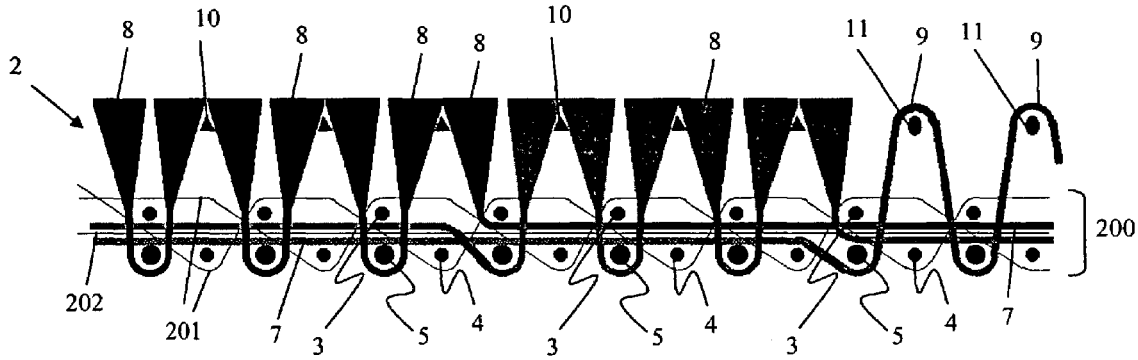
FIG. 15 is representing a schematic cross-section of a fabric in accordance with a method according to the invention with cut pile and loops, carried out on a wire weaving machine.

The first weft yarns (3) which are situated on the pile face of the fabric (1, 2) with respect to the tension warp yarns (102, 202, 103, 203), may be inserted, on the one hand, simultaneously with the third weft yarns (5) round which the pattern forming pile warp yarns (6) are interlaced, as represented in the FIGS. 1, 4, 5, 8, 15 and 18 or, on the other hand, being inserted at a different weft insertion cycle, more preferably in a next weft insertion cycle, as represented in the FIGS. 2, 3, 6, 7, 9, 10, 12-14, 17, 18. With a simultaneous weft insertion, a weave structure is obtained where two wefts are situated above one another between the pile tufts, such that the pile is maintained nicely upright and where high densities can be realized and where the tufts of a pile burl (6*a*) are pushed open rather slightly. With this, both weft yarns (first and third weft yarns (3, 5)) inserted simultaneously, may have the same thickness (as represented in the FIGS. 1, 4, 5 and 8) or the first weft yarns (3) may be thinner than the third weft yarns (5) (as represented in FIG. 15). The second weft yarns (4) which are inserted at the back of the fabric (1, 2) with respect to the non-pattern forming pile warp yarns (7) and are interlaced by the binding warp yarns (101, 201), may be interlaced either simultaneously with the first weft yarns (3) (see FIG. 3), or inserted in a different weft insertion cycle (see FIGS. 1, 2, 4, 5 up to and including 18).

For face-to-face fabrics, the first, second and third weft yarns (3, 4, 5) may be inserted by means of a double weft insertion means. In doing so, the binding warp yarns (101, 201) have a repeat ratio of 6 or a multiple of 6. In this manner ⅓ V-structures are realized, which have the advantage that no mixed contours will occur in case of a pile change and a perfectly defined fabric will be obtained in case of a colour change without any weave corrections being needed.

Figure 16:
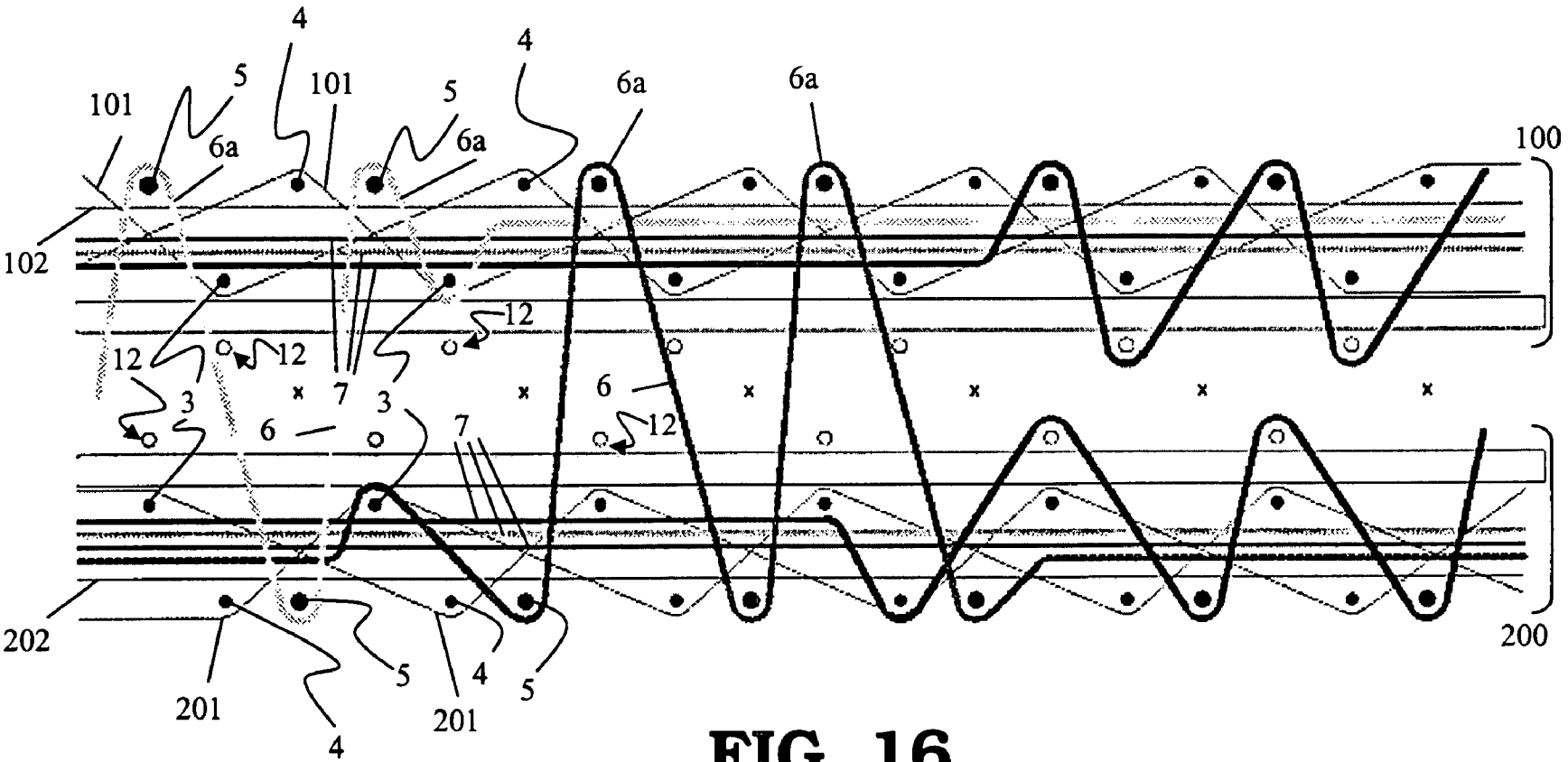
FIG. 16 is representing a schematic cross-section of a fabric in accordance with a method according to the invention with cut pile and loops, carried out on a face-to-face weaving machine.

On the other hand, for face-to-face fabrics, the first, second and third weft yarns (3, 4, 5) may be inserted by means of a triple weft insertion means. The binding warp yarns (101, 201) having a weave repeat of 4 or a multiple of 4. With triple weft insertion means the productivity is fifty percent higher than with double weft insertion means. In the face-to-face fabrics also loop pile and/or a pile which is interlaced round first weft yarns (3) may appear in addition to a cut pile, the third weft yarns (5) round which pattern forming pile warp yarns (6) are interlaced being situated outside the backing fabric (100, 200). Such weave structures are represented in FIG. 16.

Figure 9:
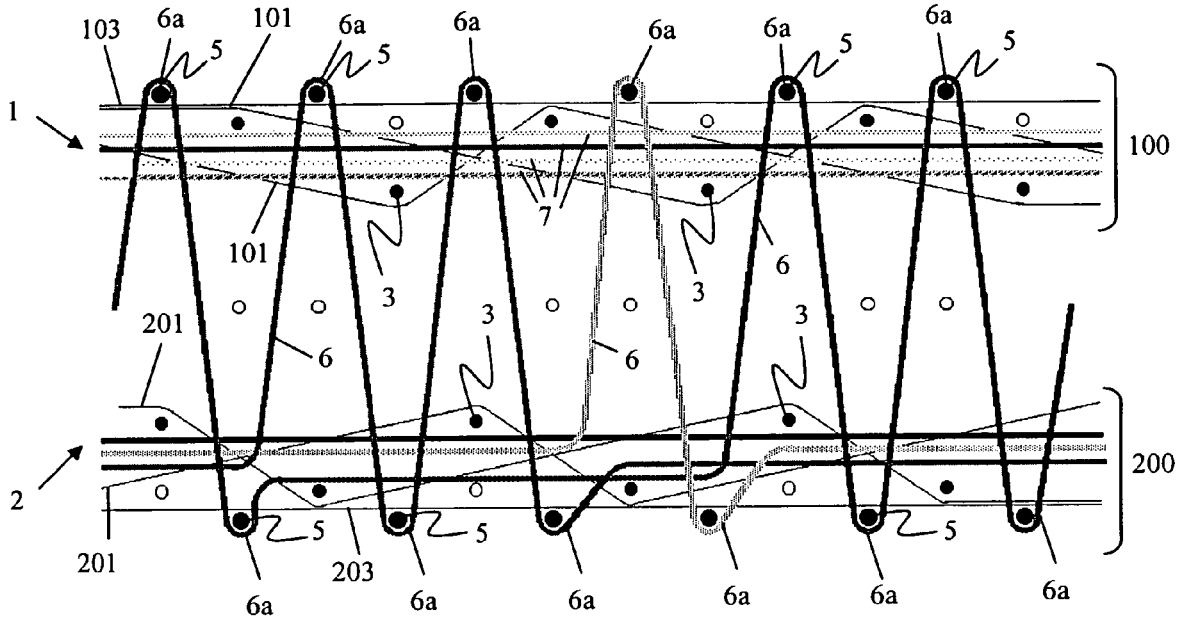
Figure 10:
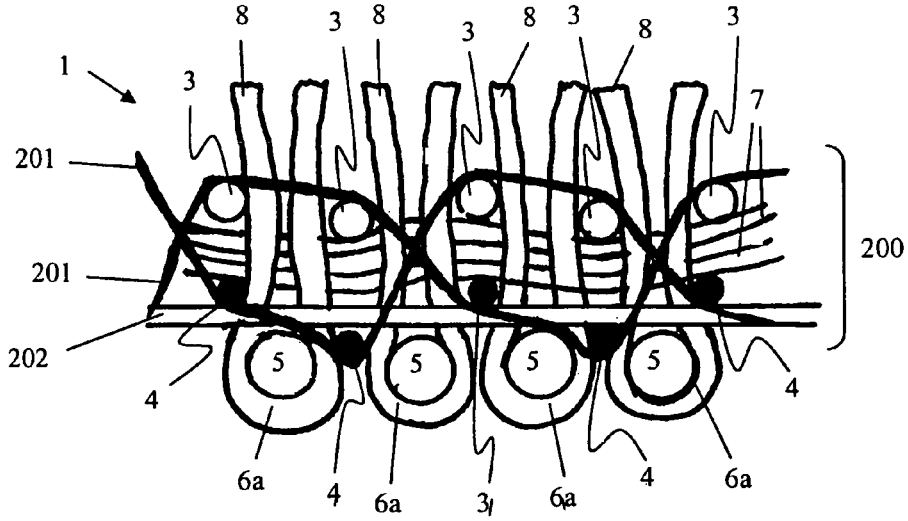
FIG. 10 is representing a cross-section of a face-to-face fabric cut through in accordance with a preferred method according to the invention.

The binding warp yarns (101, 201) may also have a weave repeat of 8, as represented in FIG. 9. In the weave structure there represented, one tension warp yarn (102, 202) is provided per fabric (1, 2), additionally a multitude of first and second weft yarns (3, 4) not being inserted into the fabric (1, 2), which, if they had indeed been inserted, would have been interlaced by the binding warp yarns (101, 201) in the backing fabric (100, 200). This reduces the number of crossings between binding warp yarns (101, 201) and the number of wefts in the fabric round which no pile is interlaced. With this method it is therefore possible to weave with a higher density.

For single fabrics, the first, second and third weft yarns (3, 4, 5) may be inserted by means of double weft insertion means, in a first weft insertion cycle 2 weft yarns being inserted and in a second successive weft insertion cycle only one weft yarn being inserted.

Furthermore, for single fabrics, the first, second and third weft yarns (3, 4, 5) may be inserted by means of single weft insertion means. The binding warp yarns (101, 201) having a weave repeat of 6 or a multiple of 6.

In case of a multiple of 4 or a multiple of 6 less warp yarn is consumed because of the number of crossings of binding warp yarns (101, 201) being smaller and this will enable higher densities to be realized. This is true both for single fabrics and for face-to-face fabrics.

Figure 11:
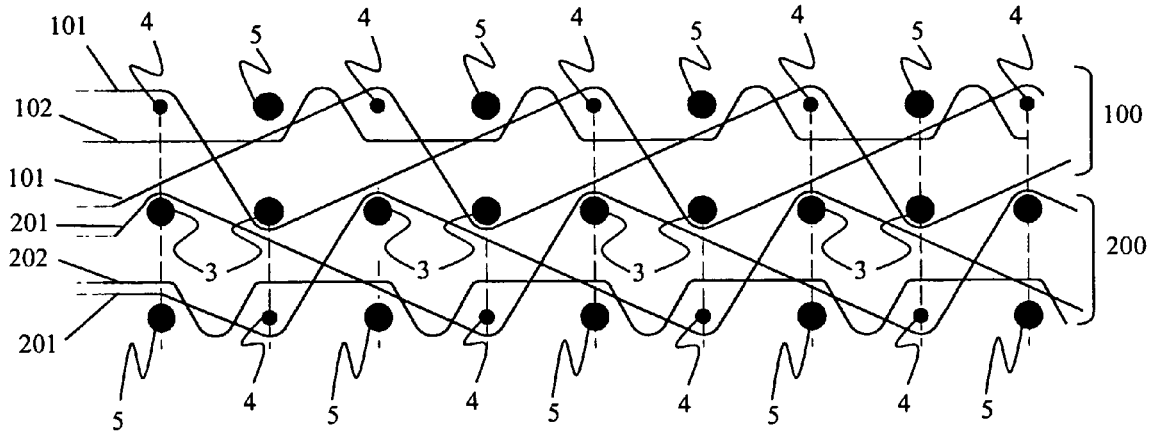
FIG. 11 is representing the path of the backing warp yarns, for a preferred method, an additional effect with the tension warp yarns being realized.

Strictly speaking, the tension warp yarns (102, 202) as represented in the FIGS. 1 up to and including 4 may remain motionless because, for the upper fabric (1), these tension warp yarns (102) have to be positioned always between the upper and the middle rapier and for the lower fabric (2) these tension warp yarns (202) have to be positioned always between the lower and the middle rapier. However, with weave structures according to the invention, it is more advantageous to link the tension warp yarns (102, 202, 103, 203) to a weaving frame drive performing a motion during which, after insertion of a third weft yarn (5) situated at the back of the fabric (1, 2) with respect to the tension warp yarns (102, 202, 103, 203) and which is not interlaced by the binding warp yarns (101, 201) and round which the pile warp yarns (6) are interlaced, the weaving frame is moving towards the back of the fabric (1, 2) in order to pull the third weft yarns (5) round which the pile warp yarns (6) are interlaced towards the outside of the jaw opening, as represented in FIG. 11, so that the pile height of the pattern forming pile warp yarns (6) can be guaranteed better and a better quality of the fabric may be realized and a more perfect back of the fabric is obtained. By jaw opening is meant the space between the upper and the lower ruler having to realize the constant pile height.

In order to be able to insert more pile burls (6*a*) per unit of length into the fabric (1, 2) and therefore to realize a higher density, an advantageous embodiment as represented in FIG. 7 consists, with weave structures having a weave repeat of a multiple of 4 or 6, in regularly interlacing one of the second weft yarns (4) on the pile side of the tension warp yarns (102, 202) situated closest to the back of the fabric (1,2), by means of a binding warp yarn (101, 201), because of which part of the first weft yarns (3) are no longer situated at the back and may force their way vertically upwards as a third layer between the layers of the other weft yarns (3, 4, 5) and non-pattern forming pile warp yarns (7).

Figure 12:
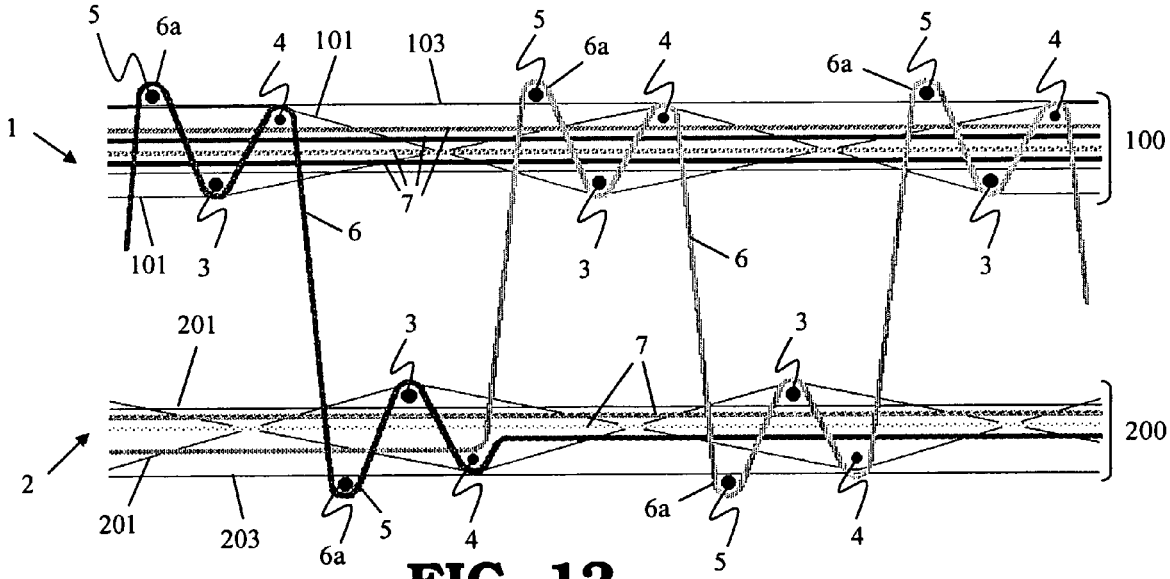
FIGS. 12 to 14 are representing schematic cross-sections of a face-to-face fabric in accordance with a preferred method according to the invention with first and second tension warp yarns.

In the FIGS. 12, 13 and 14, weave structures are represented where the second tension warp yarns (103, 203) already mentioned above are separating the third weft yarns (5) and the backing fabric (100, 200) constituted by the binding warp yarns (101, 201) and the first tension warp yarns (102, 202), the binding warp yarns (101, 201) interlacing the first and second weft yarns (3, 4) and the second weft yarns (4) being situated between the first and second tension warp yarns (102, 202, 103, 203) and the first weft yarns (3) being situated on the pile side of the fabric (1, 2) with respect to the tension warp yarns (102, 202, 103, 203).

The weft insertion occurs simultaneously with one or two weft insertion means, a first weft yarn (3), a third weft yarn (5) and a second weft yarn (4) successively being inserted, with the single rapier method as represented in FIG. 12, for a first fabric after which the same method is used for the second fabric. With the double rapier method represented in FIG. 14, successively a third weft yarn (5), a first weft yarn (3) and a second weft yarn (4) are inserted simultaneously in both fabrics, after which this cycle is repeated. In order to firmly integrate the backing fabric (100, 200), in which the binding warp yarns having been made completely invisible from the back of the fabric (1, 2) by using the method according to the invention, into the fabric (1, 2) the forming of the pile occurs with a W-pile, forming of the pile occurring, when a pattern forming pile warp yarn (6) is moving from one fabric (1, 2 respectively) to the other fabric (2, 1 respectively), by interlacing this pattern forming pile warp yarn (6) round a third weft yarn (5) which is situated at the back of the fabric (1, 2) with respect to the tension warp yarns (102, 202, 103, 203), and which is not interlaced by binding warp yarns (101, 201) and then by passing round a first weft yarn (3) in the same fabric (1, 2 respectively) and subsequently by interlacing round a second weft yarn (4) and by extending to the other fabric (2, 1 respectively). In this manner an extremely perfect back can be realized, on which no binding warp yarns (101, 201) can be observed. In combination with the single rapier method, the W-weave for the pile indeed produces a lower pile density, but this weave structure is providing a very good pile anchorage, which comes close to the pile anchorage of a hand-knotted fabric.

The lower pile density may be compensated by applying this weave structure on a double rapier weaving machine in opposition, as represented in FIG. 14, each pile motion in one fabric (1, 2 respectively) being linked to a similar pile motion in the other fabric (2, 1 respectively).

The methods represented in the FIGS. 12 and 14 have the additional advantage that per W-pile at the back only one pile burl will be visible, so that the number of pile burls of the design at the back is corresponding to the number of pile burls of the design on the pile face. Both sides are carried out in radio 1, where with a normal W-weave structure the back is carried out in radio 2, whereas the pile face is carried out in radio 1. In this context, the conception radio means the ratio between the number of points in the fabric with respect to the number of points in the drawing of the pattern. Therefore, radio 1 means, for instance, that for each point in the drawing of the pattern, one pile burl is used in the fabric, whereas with radio 2, for each point in the drawing of the pattern, 2 pile burls are used in the fabric.

As represented in FIG. 13, weaving is performed with first tension warp yarns (102, 202) situated in the backing fabric (100, 200) and second tension warp yarns (103, 203) situated outside the backing fabric (100, 200) and per weft insertion cycle, one weft is inserted, first a third weft yarn (5) being inserted, after which a second weft yarn (4) is inserted and finally a first weft yarn (3) is inserted in a cycle of three weft insertion cycles. By this method no W-pile is formed any longer, but a V-pile which may also be used with the single rapier method and which leads to a reduced pile consumption. This method may also be carried out with a double rapier in opposition (not represented in the figures). As the pattern forming pile warp yarn (6) is no longer interlacing round the central tuft of a W on a weft at the pile face of the fabric (1, 2), with respect to the tension warp yarn situated closest to the back of the fabric, because of which this weft yarn (4) will not be tightened by the pattern forming pile warp yarn (6), here also it is possible to perform weaving, by omitting one of the tension warp yarns (102, 202-103,203 respectively).

In order to solve the problem of the third weft yarns (5) which with fabrics (2) having the back below, the rapier of which, inserting them during the insertion of the said wefts, is not guided by warp yarns in its motion through the shed, during the insertion of these third weft yarns (5) into the lower fabric (2), the pattern forming pile warp yarns (6) are lifted into a position which is situated behind the rapiers, seen from the position of the weaver, this position being chosen thus, that these pile warp yarns (6) at the level of the lower rapier are positioned almost right below this lower rapier and are able to perform a guiding function for this rapier in its motion through the shed.

Such a positioning may occur by:

- using a weaving frame with a multitude of heddles provided with heddle eyes, a cord, wire or bar extending through several or all heddle eyes of this weaving frame in the weft direction and this weaving frame being lifted for the insertion of the third weft yarns (5), so that the cord, wire or bar will bring the pattern forming pile warp yarns situated below this rapier almost exactly under the lower rapier;
- dimensioning the weaving frames for driving the binding warp yarns (101) in the upper fabric (1), so that, in the said weft insertion cycle in which the lower rapier has to be supported, by providing a weaving frame for positioning the binding warp yarns (101) of the upper fabric, which at that moment is situated in its highest position, i.e. binding warp yarns (101) above the upper rapier, with a cord, wire bar or beam extending in the weaving frame in the weft direction, having brought the pattern forming pile warp yarns (6) situated under the lower rapier into a position, positioning these pattern forming pile warp yarns (6), at the level of the lower rapier almost right under the lower rapier;
- using one or several servo-driven weaving frames, the motion of the weaving frame being adjustable and programmable as to height, and these weaving frames with binding warp yarns (101) situated above the upper rapier at the moment the lower rapier has to be supported being driven, slightly higher than usual, when they are provided with a device to lift the pattern forming pile warp yarns (6) under the lower rapier in order to position them almost right under the lower rapier;
- using a weaving frame or table being movable up and down, the top of which is provided with a plane positioning the pattern forming pile warp yarns almost right under the lower rapier;
- using a fixed table which will always position the pattern forming pile warp yarns (6) almost right under the lower rapier, the table being preferably installed as close as possible to the rapiers, in order to keep, in positions in which binding warp yarns (201) are situated under the lower rapier, the zone inside which pile warp yarns and binding warp yarns are converging, as short as possible.

This problem can also be solved by providing additional warp yarns, not being part of the fabric and taking up a fixed position or a position controlled by a shed forming means, in order to support the lower rapier during the insertion of a third weft yarn (5) in the lower fabric (2). These additional warp yarns may be more limited in number than the number of backing warp systems, so that such additional warp yarns are not present in each backing warp system. Afterwards these additional warp yarns have to be removed in the known manner (see EP 1460157), as they are no part of the fabric. These additional warp yarns may also be carried out as fixed strings, having a course so that, at the level of the lower rapier, they are situated at a level under this rapier, so that the rapier may be guided on them.

Single fabrics may be realized by means of the method according to the invention by means of different weaving techniques.

On the one hand, there is the technique of wire weaving, cutting wires (10) being used to form the cut pile (8) and/or loop wires (11) being used to form a loop pile (9), as represented in FIG. 15. Although the productivity with respect to face-to-face weaving is at least reduced by half, as only one fabric instead of two fabrics are simultaneously woven, this method has the advantage that different structures may be brought into the fabric (1). A combination of cut pile (8) and loop pile (9) in the same fabric (1) may be realized with the method according to the invention also in face-to-face fabrics, for instance, by applying the method described in EP 1347087 in combination with an adapted method to insert weft yarns. An example of a weave structure according to this method is represented in FIG. 16. The method is carried out with a weaving machine which is inserting three wefts simultaneously by means of three weft insertion means. In each weft insertion cycle the two outer weft insertion means are inserting a first, second or third weft yarn (3, 4, 5) in each of the fabrics (1, 2), in a manner in which after three weft insertion cycles in both fabrics (1, 2) a first, second, as well as a third weft yarn (3, 4, 5) are inserted and in which during three successive weft insertion cycles a lost weft (12) is inserted in two of these cycles by means of the middle weft insertion means, which, after cutting through both fabrics (1, 2) is removed from the fabric (1, 2), whereas in the remaining cycle of the three successive weft insertion cycles no lost weft yarn (12) is inserted, because no weft yarn is presented to the rapier or because the middle rapier is prevented from moving through the shed. Preferably, the effectively inserted lost weft yarns (12) are inserted during the weft insertion cycle, following a cycle in which a third weft (5) is inserted in one of the fabrics (1, 2 respectively). As represented in FIG. 16 such a weave structure enables a fabric to be created by means of the method of the invention, in which both cut pile (8) and loop pile (9) are occurring and in which also a pile may occur which is interlaced on the pile side of the fabric (1, 2) round one or several first weft yarns (3) (not represented in the figure).

The wire weaving machine may be equipped with a band rapier as a weft insertion means, enabling this band rapier to be guided during its trajectory through the shed on guiding fingers which are installed divided in the weft direction of the weaving machine. This is to avoid that the solutions mentioned above have to be used to guide the rapier when a third weft yarn (3) has to be inserted into a fabric (2) having its back below, which will not be interlaced by binding warp yarns (101).

With single fabric weaving, the method according to the invention may also be used for Axminster weaving. In principle, Axminster weaving is a three-shot weaving technique. This means that three weft insertion cycles are needed to insert one pile burl. In these classic Axminster weave structures, per three weft insertion cycles, there are 2 weft yarns on the pile face of the fabric and 1 weft yarn, with respect to the tension warp yarns, at the back of the fabric and the three weft yarns are interlaced by binding warp yarns. In the method according to the invention, as represented in the FIGS. 15 and 17, two weft yarns (4, 5) are provided at the back of the fabric (1) with respect to the tension warp yarns (102), and only one weft yarn (3) is provided on the pile face of the fabric (1) with respect to the tension warp yarns (102). The third weft yarns (5), round which pile is laid by the grippers are interlaced outside the backing fabric (100) by this pile. On an Axminster weaving machine, the rapiers are bringing the weft through the shed and the grippers are laying the pile tufts round the weft, round which the pile has to be interlaced. As with Axminster weaving there is no non-pattern forming pile, the second weft yarns (4), when they are inserted, are always lying at the back of the fabric with respect to the tension warp yarns (102). In order to realize more tightly woven fabrics, insertion of the second weft yarn (4) may be cancelled now and then, or now and then the rapier may be disengaged before inserting the second weft yarn (4). Another method to obtain more tightly woven fabrics consists in providing second tension warp yarns, lying outside the backing fabric and which will ensure that the second (4) and the third (5) weft yarns are laid in two layers above one another.

With Axminster weaving the problem arises that the shed has no warp yarns which are positioned under the lower rapier when they are not interlaced by binding warp yarns, as the pile warp yarns are inserted by the grippers into the fabric in a cut condition. Neither a fixed or movable table can be used to support the lower rapier, as the weft round which the pile warp yarn is interlaced the moment the weft is inserted, is still taken up in the grippers which at that time is situated under the rapier and might collide with the provisions mentioned above to guide the lower rapier. In addition to the solution to provide additional warp yarns, not being part of the fabric, this problem may also be solved by providing the Axminster weaving machine with a stopping reed, comprising a multitude of plate-shaped reed fingers, provided with recesses in order to support the lower rapier in its motion through the shed (as described in GB 2 314 095).

When applying the method according to the invention with the Axminster weaving technique there is the advantage that to realize a fabric having the aspect of a hand-knotted fabric, Axminster weaving enables coarser yarns to be woven in a multitude of colours. The coarser yarns have the advantage that the much thinner binding warp yarns which are interlacing the second weft yarns (4) at the back are better covered which may be further improved by a thicker weft yarn as a third weft yarn (5). The absence of non-pattern forming pile warp yarns (6) is also a feature of a hand-knotted fabric which may thus be realized. The aspect of more colours by means of the Axminster weaving technique is coming closer to the possibilities which may be realized with hand-knotted fabrics.

Figure 17:
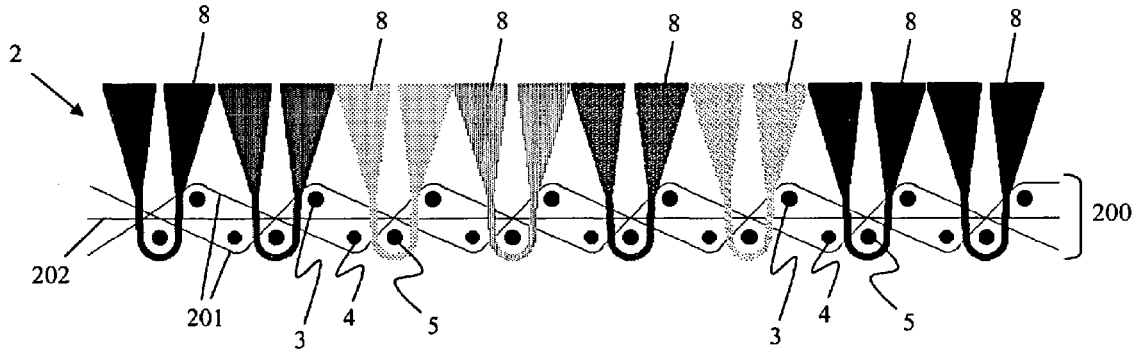
FIGS. 17 to 18 are representing schematic cross-sections of a fabric in accordance with a method according to the invention, carried out on an Axminster weaving machine.
Figure 18:
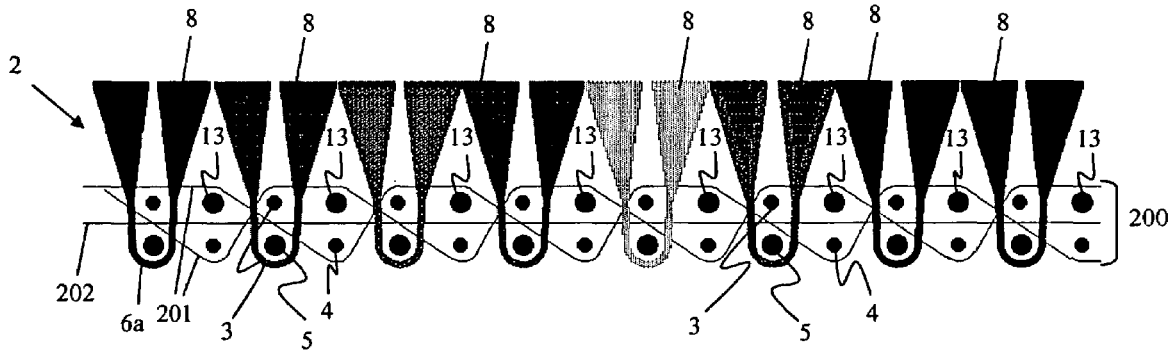

In the European patent EP 1 033 426 is described how a non-through-woven three-shot weave may be realized on an Axminster weaving machine with a double rapier system. This double rapier system may also be used for weaving the fabric in accordance with FIG. 17, provided one of the rapiers is disengaged by inserting the third weft yarn (5) not interlaced by binding warp yarns (101). However, with a double rapier Axminster weaving machine, also a weave structure according to FIG. 18 may be realized, per weft insertion cycle two wefts being inserted, so that, with respect to the fabric as represented in FIG. 17 an additional fourth weft yarn (13) may be added which, together with the third weft yarn (5) is inserted. This weave structure has the advantage of having the same density of weft yarns (3, 4, 5, 13) warp yarns (pile warp yarns (6, 7) and backing warp yarns (101, 102) on either side of the tension warp yarn (102). This leads to a fabric (1) that will curl up less and therefore will remain more flat. As represented in FIG. 18, on either side of the tension warp yarn (102) a weft yarn (5, 13) may be provided as a thick yarn, preferably inserted in a different weft insertion cycle.

The weaving machines to perform the methods according to the invention and for weaving the fabrics according to the invention have to be provided with a Jacquard machine. For this purpose, Jacquard machines in accordance with the state-of-the-art may be used.

For Axminster weaving, specific devices are known to present pile yarns to the grippers in accordance with the pattern selected. For the other single fabric and face-to-face weaving machines operating in accordance with the method with non-pattern forming warp yarns, open shed Jacquard machines may be used, known in the state-of-the-art, with 2, 3 or 4 positions, with the possibility to use the two position open shed Jacquard machines for single rapier weaving, 3-position open shed Jacquard machines may be used for double rapier and three-rapier weaving, whereas 4-position open shed Jacquard machines may be used for three-rapier weaving, more particularly for fabrics as represented in FIG. 16.

Non-open shed Jacquard machines may also be used for those fabrics in which not all the positions have to be reached in each weft insertion cycle, provided they will be able to realize the necessary positions at the moments they are required.

A further preferred method according to the invention consists in making the non-pattern forming pile warp yarns to float between the first weft yarns (3) of the lower fabric (2) and the first weft yarns (3) of the upper fabric (1). Non-pattern forming pile warp yarns (7) which are positioned in the fabric in this manner are known by the name of "middle floaters". After cutting through the fabrics (1, 2) both fabrics (1, 2) may be subjected to a scraping operation, so that the non-pattern forming pile warp yarns (7) situated on the pile face of the fabric (1, 2), are removed from the fabric (1, 2). This will create the possibility to weave at a higher weft density, so that the wefts (3, 4, 5) will be situated more tightly together, because of which also the number of pile points per $m^2$ is increasing. Besides, the wefts (3, 4, 5) becoming situated more tightly together will ensure a still improved pile anchorage.

As a hand-knotted carpet has no non-pattern forming pile warp yarns, the fabric obtained with this method is also coming close to this characteristic of the hand-knotted carpet. Moreover, this method with middle floaters has the advantage that no mixed contours will occur and that no correction lift plans will be needed either to avoid mixed contours. Pile tufts situated next to one another of a different colour will not be crossing, so that a clear and fine pattern will be obtained on the pile face of the fabric.

Figure 19:
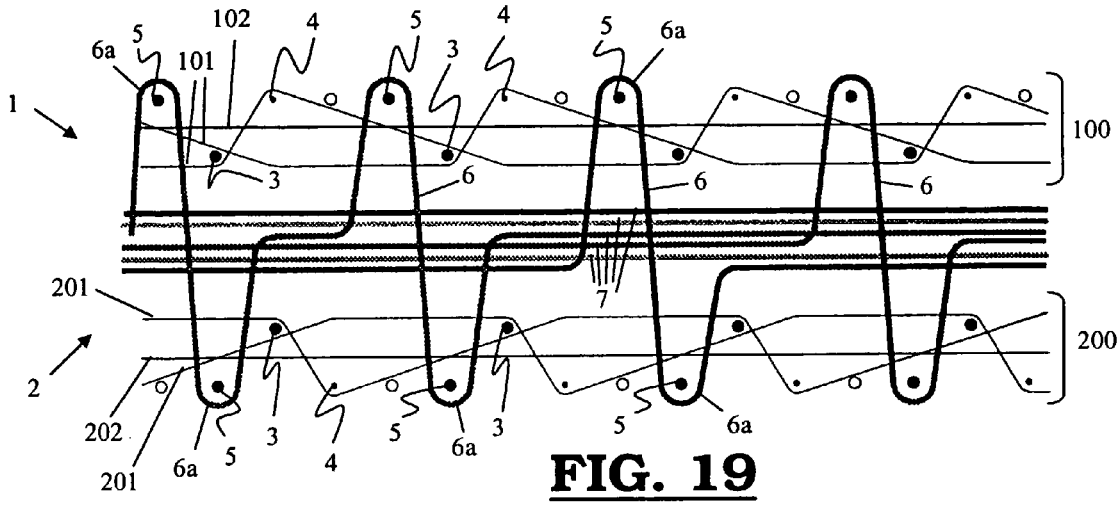
FIGS. 19 up to and including 21 are representing schematic cross-sections of a fabric in accordance with a method according to the invention, the non-pattern forming pile extending between the third wefts of both fabrics.

When we apply this method to a double rapier weaving machine as represented in FIG. 19, we will observe that the non-pattern forming pile warp yarns may maintain their position with respect to the rapiers through the various machine cycles, because of which the number of pile warp yarns which have to be moved at each shot is strongly reduced. Only the pattern-forming pile warp yarns have their positions to be changed by the Jacquard machine. This reduces the load on the Jacquard machine and will increase the weaving efficiency at high weaving densities, as less pile warp yarns are moving and colliding with other yarns and with the spacers.

Figure 20:
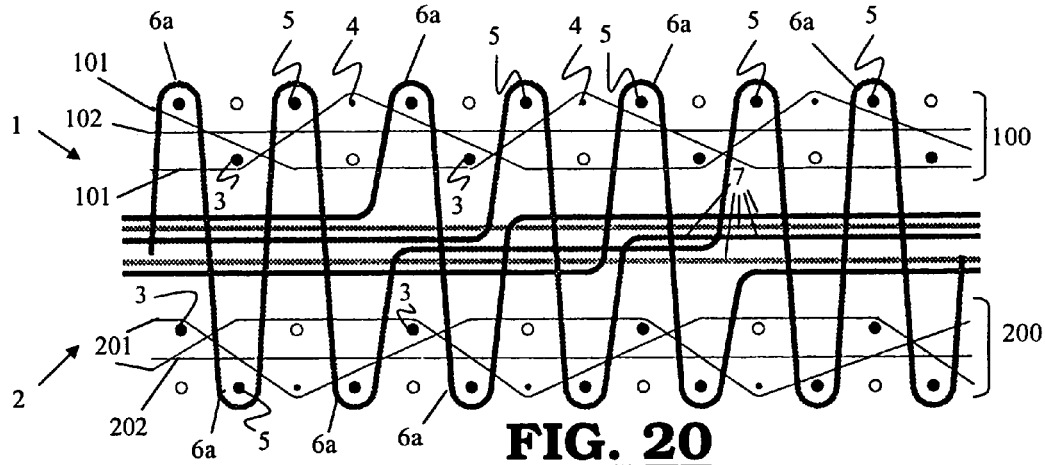

In FIG. 20, the method is represented being carried out on a three-rapier weaving machine. With this method, fabrics free of mixed contours are realized at a high degree of productivity. The absence of non-pattern forming pile warp yarns in the backing fabrics enables the weft density to be increased, so that a fabric with a higher density is realized, coming closer to the hand-knotted fabric. In the figure represented, per weft insertion cycle, one weft is not inserted. (This is represented in the drawing by a non-coloured circle). This enables the weft density to be further increased. When, as represented in FIG. 20, a thinner weft is used for the second weft yarn than for the third weft yarn (3), the tension warp at the back of the fabric (1, 2) is hidden better still under the pile warp yarns (6).

Figure 21:
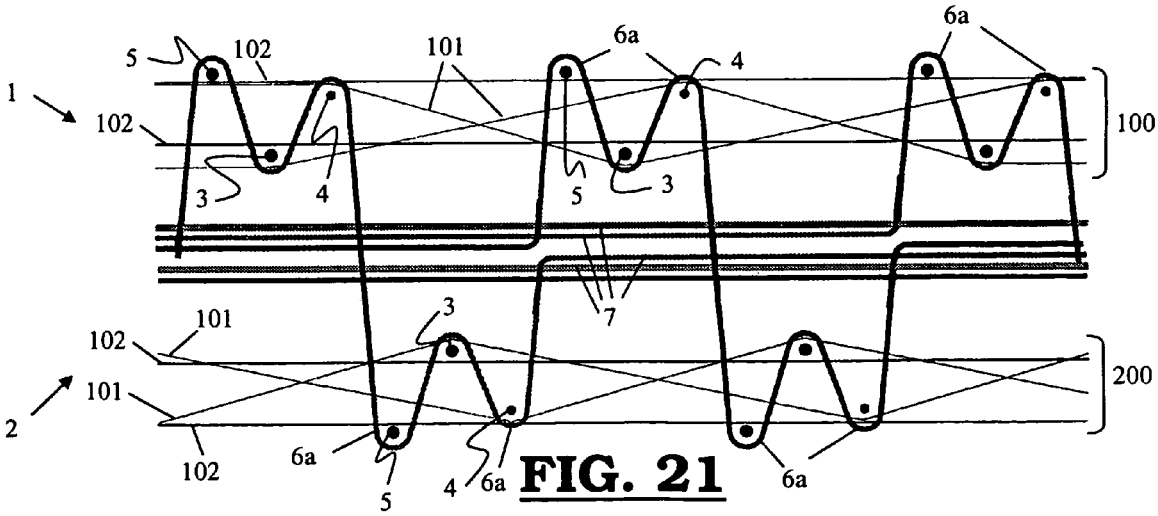

In FIG. 21, a fabric in accordance with a method according to the invention is represented, the pattern forming warp yarns being interlaced in W-weave by means of a single rapier weaving machine in combination with non-pattern forming pile warp yarns as middle floaters. Here, the strong pile anchorage of a W-weave is still further reinforced because by the absence of non-pattern forming pile warp yarns in the backing fabrics, the wefts situated in 3 layers above one another may be inserted more tightly.

In this fabric, two tension warp yarns (102, 202) are inserted per backing fabric, one tension warp yarn extending between the second (4) and the third (5) weft yarns. This will cause a still better separation between the layers constituted by the various weft yarns (first weft yarns (3), second weft yarns (4) and third weft yarns (5)). This will result in a still finer design at the back of the fabric because of the total absence of second weft yarns (4) visible at the back of the fabric and will also allow for higher densities of the fabric.

The invention claimed is:

1. Method for weaving a fabric (1, 2) comprising:

providing a backing fabric (100, 200) formed by backing warp yarns, comprising binding warp yarns (101, 201) and first and second weft yarns (3, 4);

providing one or several tension warp yarns (102, 202, 103, 203);

providing non-pattern forming and pattern forming pile warp yarns (7, 6), forming pattern forming pile burls (6*a*) from the pattern forming pile warp yarns, and interlacing each pattern forming pile burl (6*a*) round at least one third weft yarn (5), situated at the back of the fabric (1, 2) with respect to the tension warp yarns (102, 202, 103, 203);

further comprising situating each said third weft yarn (5) outside the backing fabric (100, 200).

2. Method according to claim 1, further comprising interlacing said second weft yarns (4) which are situated at the back of the fabric (1, 2) with respect to the tension warp yarns (102, 202, 103, 203) and round which no pattern forming pile warp yarns (6) are interlaced with binding warp yarns (101, 201).

3. Method according to claim 1, further comprising interlacing said second weft yarns (4) which are situated on the pile face of the fabric (1, 2) with respect to the tension warp yarns (102, 202, 103, 203), which are situated closest to the back of the fabric (1, 2), with binding warp yarns (101, 201).

4. Method according to claim 3, further comprising providing at least part of the second weft yarns (4) between the said tension warp yarns (102, 202, 103, 203), which are situated closest to the back of the fabric and the non-pattern forming pile warp yarns (7).

5. Method according to claim 1, further comprising interlacing the said first weft yarns (3) which are situated on the pile face of the fabric (1, 2) with respect to the tension warp yarns (102, 202, 103, 203) with the binding warp yarns (101, 201).

6. Method according to claim 5, further comprising floating the non-pattern forming pile warp yarns (7) between the first and the second weft yarns (3, 4) which are interlaced in the backing fabric (100, 200) by binding warp yarns (101, 201).

7. Method according to claim 5, further comprising floating the non-pattern forming pile warp yarns (7) between the first weft yarns (3) of a lower fabric (2) and the first weft yarns (3) of an upper fabric (1).

8. Method according to claim 1, further comprising inserting the first weft yarns (3) on the pile face of the fabric (1,2) simultaneously with the third weft yarns (5) round which pattern forming pile warp yarns (6) are interlaced.

9. Method according to claim 1, further comprising inserting the first weft yarns (3) on the pile face of the fabric (1,2) in respect to the third weft yarns (5) with a different weft insertion cycle.

10. Method according to claim 9, further comprising inserting the second weft yarns (4) which are inserted at the back of the fabric (1, 2) with respect to the non-pattern forming pile warp yarns (7) and are interlaced by the binding warp yarns (101, 102) simultaneously with the first weft yarns (3).

11. Method according to claim 1, further comprising inserting the second weft yarns (4) which are inserted at the back of the fabric (1, 2) with respect to the non-pattern forming pile warp yarns (7) and are interlaced by the binding warp yarns (101, 201) in a different weft insertion cycle with respect to the first weft yarns (3).

12. Method according to claim 1, further comprising for face-to-face fabrics, inserting the first, second and third weft yarns (3, 4, 5) by means of triple weft insertion means.

13. Method according to claim 12, characterized in that in addition to a cut pile (8) also a loop pile (9) occurs and/or a pile which is interlaced round first weft yarns (3), the third weft yarns (5) round which pattern forming pile warp yarns (6) are interlaced are situated outside the backing fabric (100, 200).

14. Method according to claim 1, further comprising for face-to-face fabrics, inserting the first, second and third weft yarns (3, 4, 5) by means of double weft insertion means.

15. Method according to claim 1, further comprising for single fabrics, inserting the first, second and third weft yarns (3, 4, 5) by means of double weft insertion means, inserting in a first weft insertion cycle 2 weft yarns and in a second successive weft insertion cycle inserting only 1 weft yarn.

16. Method according to claim 1, further comprising for single fabrics, inserting the first, second and third weft yarns (3, 4, 5) by means of single weft insertion means.

17. Method according to claim 12, characterized in that the binding warp yarns (101, 201) have a weave repeat of 4 or a multiple of 4.

18. Method according to claim 14, characterized in that the binding warp yarns (101, 201) have a weave repeat of 6 or a multiple of 6.

19. Method according to claim 17, characterized in that the binding warp yarns (101, 201) have a weave repeat of at least 8, and between the crossing of the binding warp yarns (101, 201) a weft insertion means leading no weft yarns through the fabric (1,2) during at least one weft insertion cycle, which if weft yarns had indeed been inserted by the weft insertion means would have been interlaced by binding warp yarns (101, 201) into the backing fabric (100, 200).

20. Method according to claim 1, further comprising linking at least part of the tension warp yarns (102, 202, 103, 203) to a weaving frame drive performing a motion by which, after the insertion of a third weft yarn (5) situated at the back of the fabric (1, 2) with respect to the tension warp yarns (102, 202, 103, 203) and which is not interlaced by the binding warp yarns (101, 201) and round which the pattern forming pile warp yarns (6) are interlaced, the weaving frame is moving towards the back of the fabric (1, 2) to pull the third weft yarns (5), round which the pattern forming pile warp yarns (6) are interlaced, towards the outside of the jaw opening.

21. Method according to claim 17, further comprising situating at least part of the second weft yarns (4) which are interlaced by binding warp yarns (101, 201) on the pile face of the tension warp yarns (102, 202, 103, 203), which are situated closest to the back of the fabric (1, 2).

22. Method according to claim 5, characterized in that second tension warp yarns (103, 203) are making a separation between the third weft yarns (5) and the backing fabric (100, 200) constituted by the binding warp yarns (101, 201) and the first tension warp yarns (102, 202), the binding warp yarns (101, 201) interlacing the first and second weft yarns (3, 4) and the second weft yarns (4) being situated between the first and second tension warp yarns (102, 202, 103, 203) and the first weft yarns (3) being situated on the pile face of the fabric (1,2) with respect to the tension warp yarns (102, 202, 103, 203).

23. Method according to claim 22, further comprising conducting the weft insertion simultaneously by means of two weft insertion means, in each fabric a third weft yarn (5) and a first weft yarn (3) being successively inserted, after which this cycle is repeated.

24. Method according to claim 22, characterized in that the pile forming with face-to-face fabrics occurs with a W-pile, the pile forming occurring by, when a pattern forming pile warp yarn (6) is moving from one fabric to another (1, 2 respectively), interlacing this pile warp yarn (6) round a third weft yarn (5) situated at the back of the fabric (1, 2) with respect to the tension warp yarns (102, 202, 103, 203) and which is situated outside the backing fabric (100, 200) and subsequently to pass round a first weft yarn (3) in the same fabric (1, 2 respectively) and subsequently to interlace round a second weft yarn (4), which is interlaced by a binding warp yarn (101, 201) and is separated from the third weft yarns (5) by a tension warp yarn (102, 202, 103, 203), and to extend towards the other fabric (2, 1 respectively).

25. Method according to claim 24, further comprising applying the weave structure with a double rapier weaving machine in opposition, each motion of the pile in the one fabric (1, 2 respectively) being linked to a similar pile motion in the other fabric (2, 1 respectively).

26. Method according to claim 1, further comprising for fabrics with the back below, lifting the pattern forming pile warp yarns (6) which are interlaced round the third weft yarns (5) to form the lower fabric (2) into a position situated behind the rapiers, seen from the position of the weaver, this position being chosen such that these pile warp yarns (6) at the level of the lower rapier are positioned almost right under this lower rapier and may be able to perform a guiding function for this rapier in its motion through the shed.

27. Method according to claim 26, further comprising using a weaving frame having a multitude of heddles which are provided with heddle eyes, a cord, wire or bar extending through several or all heddle eyes of the weaving fame in the weft direction and lifting this weaving frame to insert the third weft yarns (5), so that the cord, wire or bar will bring the pattern forming pile warp yarns (6) situated under this rapier, almost exactly under the lower rapier.

28. Method according to claim 26, characterized in that the weaving frames are dimensioned for driving the binding warp yarns (101) in the upper fabric (1), so that in their highest position, i.e. binding warp yarns (101) above the upper rapier, by means of a cord, wire, bar or beam extending in the weft direction they will lift also the pattern forming pile warp yarns (6) which are situated in the lower position in order to position them almost exactly under the lower rapier.

29. Method according to claim 26, further comprising using one or several servo-driven weaving frames, the motion of the weaving frame being adjustable and programmable as to height, and these weaving frames with binding warp yarns (201), which, the moment the lower rapier has to be supported, are situated above the upper rapier, are driven slightly higher than usual, when they are provided with a device to lift the pattern forming pile warp yarns (6) under the lower rapier in order to position them almost exactly under the lower rapier.

30. Method according to claim 26, further comprising using a weaving frame or table being movable up and down, the top of which is provided with a plane which will position the pattern forming pile warp yarns (6) almost exactly under the lower rapier.

31. Method according to claim 26, further comprising using a fixed table which will position the pattern forming pile warp yarns (6) always almost right under the lower rapier.

32. Method according to claim 26, characterized in that a table is installed as close as possible to the rapiers.

33. Method according to claim 1, further comprising for fabrics (2) with the back below, using additional warp yarns or strings which are not part of the fabric (2) and which at the level of a lower rapier are taking up a position enabling the lower rapier to be guided, when a third weft yarn (5) is inserted into this fabric (2).

34. Method according to claim 1, further comprising weaving the single fabrics by means of a wire weaving machine, the wires (10) being used to form a cut pile (8) and/or loop wires (11) being used to form pile loops (9).

35. Method according to claim 34, characterized in that the wire weaving machine is equipped with a band rapier as a weft insertion means, this band rapier being guided during the trajectory through the shed.

36. Method according to claim 1, further comprising weaving the single fabrics by means of an Axminster weaving machine, between crossing the binding warp yarns (201) a second and a third weft yarn (4, 5) being laid at the back of the fabric (2) with respect to the tension warp yarns (202) and a first weft yarn (3) is laid on the pile face of the fabric (1) with respect to the tension warp yarns (202) and the third weft yarn (5), round which the grippers are laying pile, being interlaced by this pile outside the backing fabric (200).

37. Method according to claim 36, further comprising inserting two wefts, so that, together with the second weft yarns (4) additional fourth weft yarns (13) are inserted which, as the first weft yarns (3), are situated on the pile face of the fabric (1, 2) with respect to the tension warp yarns (102, 202, 103, 203) and are interlaced by binding warp yarns (101, 201).

38. Method according to claim 36, further comprising providing the Axminster weaving machine with a beating up reed, comprising a multitude of plate-shaped reed fingers provided with recesses in order to support the lower rapier in its motion through the shed.

39. Method according to claim 1, characterized in that the thickness of the third weft yarns (5) is greater than the thickness of the second weft yarns (4).

40. Method according to claim 1, characterized in that the third and the first weft yarns (5, 3) are practically of the same thickness.

41. Method according to claim 1, characterized in that the thickness of the first weft yarns (3) is smaller than the thickness of the third weft yarns (5).

42. Fabric comprising:

a backing fabric (100, 200) constituted by backing warp yarns, comprising binding warp yarns (101, 201) and first and second weft yarns (3, 4);

one or several tension warp yarns (102, 202, 103, 203);

non-pattern forming and pattern forming pile warp yarns (7, 6), the pattern forming pile warp yarns (6) forming pattern forming pile burls (6*a*), and each pattern forming pile burl (6*a*) being interlaced round at least one third weft yarn (5), which is situated at the back of the fabric (1, 2) with respect to the tension warp yarns (102, 202, 103, 203)

characterized in that each said third weft yarn (5) is situated outside the backing warp (100, 200).

43. Weaving machine, characterized in that the weaving machine is provided for weaving a fabric according to claim 42.

* * * * *